US006957877B1

(12) United States Patent
Chiu

(10) Patent No.: US 6,957,877 B1
(45) Date of Patent: Oct. 25, 2005

(54) BRAKING SLIDE STRUCTURE FOR DRAWER INTERLOCK

(75) Inventor: I-Hsiang Chiu, Taipei (TW)

(73) Assignee: Nan Juen International Co., Ltd., Taipei (TW)

( * ) Notice: Subject to any disclaimer, the term of this patent is extended or adjusted under 35 U.S.C. 154(b) by 0 days.

(21) Appl. No.: 10/879,006

(22) Filed: Jun. 30, 2004

(51) Int. Cl.[7] ..... E05C 7/06
(52) U.S. Cl. ..... 312/221; 312/217
(58) Field of Search ..... 312/216, 217, 312/218, 219, 220, 221, 222, 107.5; 292/DIG. 18

(56) References Cited

U.S. PATENT DOCUMENTS

| | | | | |
|---|---|---|---|---|
| 4,957,334 A * | 9/1990 | Lakso | ..... | 312/221 |
| 5,352,030 A * | 10/1994 | Derle et al. | ..... | 312/221 |
| 6,238,024 B1 * | 5/2001 | Sawatzky | ..... | 312/221 |
| 2004/0036387 A1 * | 2/2004 | Ludwig et al. | ..... | 312/221 |

FOREIGN PATENT DOCUMENTS

| | | | | |
|---|---|---|---|---|
| CH | 289618 | * 3/1953 | ..... | 312/217 |
| GB | 2096229 | * 10/1982 | | |

* cited by examiner

*Primary Examiner*—James O. Hansen
(74) *Attorney, Agent, or Firm*—Troxell Law Office, PLLC

(57) ABSTRACT

This invention relates a braking slide structure of the drawer interlock wherein the braking slide is composed of detachable bracket board and the insert sleeve. The bracket board is designed with a guide channel formed by side walls and with the guide stud to limit the bracket board sliding off the bracket. This drawer interlock is mounted on the drawer slides and rails, entailing additional installation of a pair of braking slides. The drawer interlock is an integral element fixed on the drawer for simplified assembly and operation. The braking rod is easy to be inserted into the insert sleeve linking to the top of the bracket board. The bracket board exposes to the outside of the slide hole on the bracket which is easy for the braking rod to slip into the insert sleeve and reach to the top of the bracket board with no space restraint.

5 Claims, 11 Drawing Sheets

BRAKING SLIDE STRUCTURE FOR DRAWER INTERLOCK

BACKGROUND OF THE INVENTION

1. Field of the Invention

This invention concerns a new creation of a drawer interlock, in particular the braking slide structure of the drawer interlock.

2. Description of the Related Art

For most upright multiple draws cabinets, when one of the draws is opened, the upper draw and the lower draw will slide open too. As shown in FIG. 1, there installs a drawer interlock 1', the drawer interlock 1' consisting of a bracket 11', a cam 12' and two braking slides 13' as shown in FIG. 2 & FIG. 3, in which the cam 12' is locked in the cam hole 111' of the bracket 11' by pivot axle 121'. The stud 122' at one end of the cam 12' will move along the curved groove 22' on the poker 21' of the drawer slide 2' to make a 90° turn. Two braking slides 13' are inserted into the slide slot 112' of the bracket 11' from both ends and the leg 131' of the braking slides will touch the cam 12'. When the stud 122' on the cam 12' is driven by the drawer rail 3', two braking slides 13' are forced to extend outward and the upper braking rod 4' will stop the displacement of the upper drawer and the lower braking rod 4' will limit the sliding of the lower drawer in cabinet. When the drawer is closed, the rail 3' will drive the stud 122' of the 12', and the braking slides 13' and the braking rods 4' will return to original closing position. This drawer interlock will always keep the upper and lower drawers in closed position.

From the view point of design, the drawer interlock 1' is mounted on the drawer slide 2' and the rail 3' to form an integral element, but not for two braking slides 13' which are easily to fall off the bracket 11', particularly the lower braking slide 13'. Furthermore, it requires installing the braking slides 13' respectively, a complicated time consuming assembly and a place for improvement.

SUMMARY OF THE INVENTION

Based on the operational requirement of the drawer interlock, the inventor has advocated for years the great effort to improving the design in an attempt to shorten the assembly time and decrease the production cost in order to hone the competitive edge.

The technology this invention has adopted is to divide the drawer interlock into two detachable parts, the base plate and the insert sleeve. The side wall of the base plate main is bent to form a slide channel with a projected stud to ensure that the base plate is always held firmly in the clamp of the bracket. The drawer interlock is therefore designed to be mounted on the drawer slide and rail without separate assembly of the braking slides. In other word, the drawer interlock along with the braking slides is an integral element directly mounted on the drawer to simplify the assembly as well as the operation. The braking rod is inserted onto the base plate via the insert sleeve. The base plate of the braking slide exposes to the slide hole of the bracket, so the braking rod can be inserted in the first stage into the insert sleeve and in the second stage onto the top of the base plate. The travel of the braking rod is not obstructed and the alignment of the braking rod to the base plate is easy which will absolutely shorten the assembly time in the production line.

DETAILED DESCRIPTION OF THE INVENTION

Figure 1:
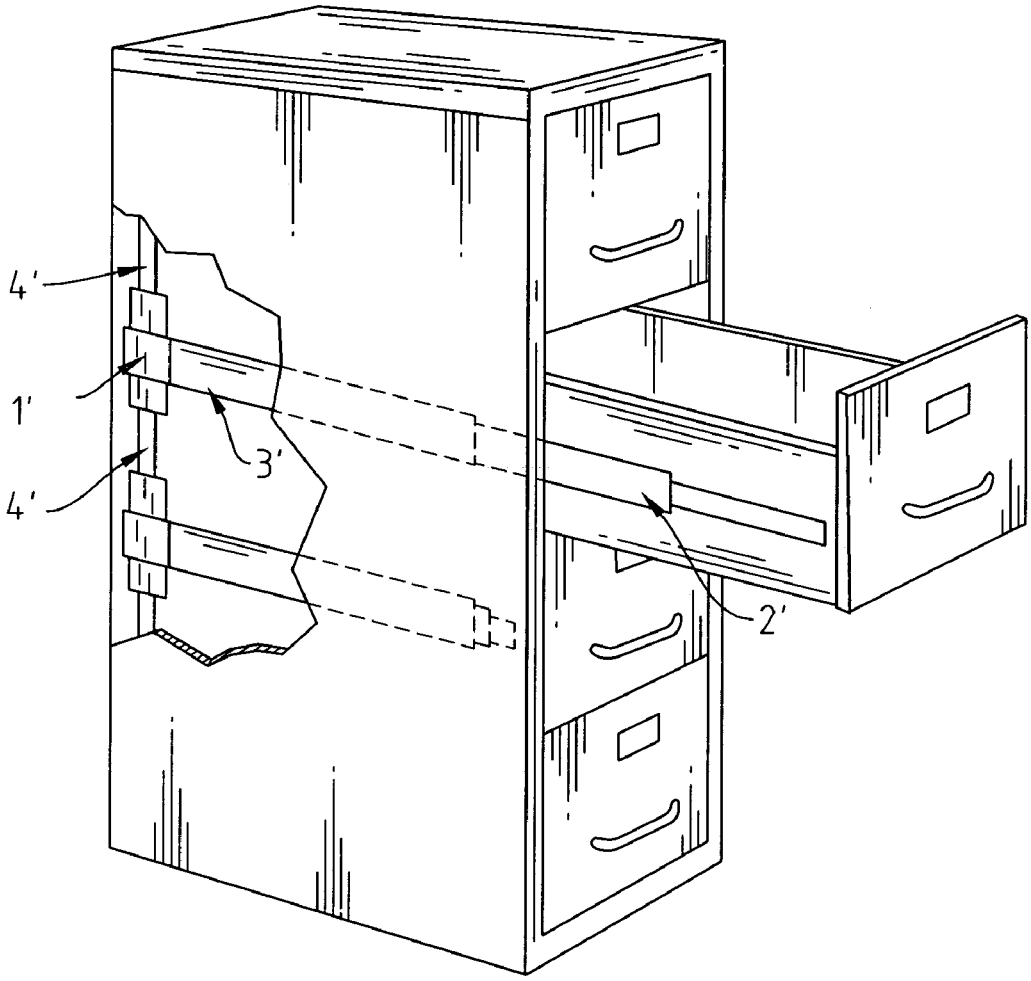
Fig. 1 Prior Art
FIG. 1 shows the embodiment of prior art of the drawer interlock.
Figure 2:
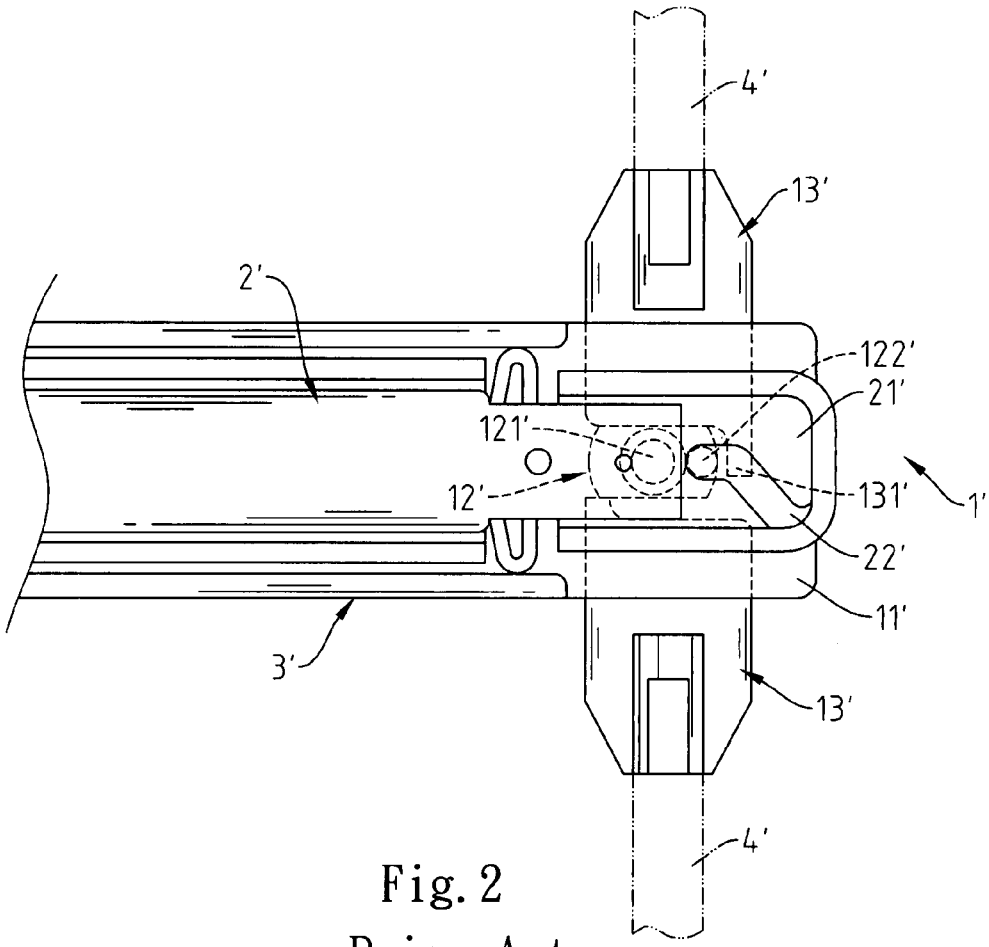
Fig. 2 Prior Art
FIG. 2 shows the layout of each part of the prior art of drawer interlock.
Figure 3:
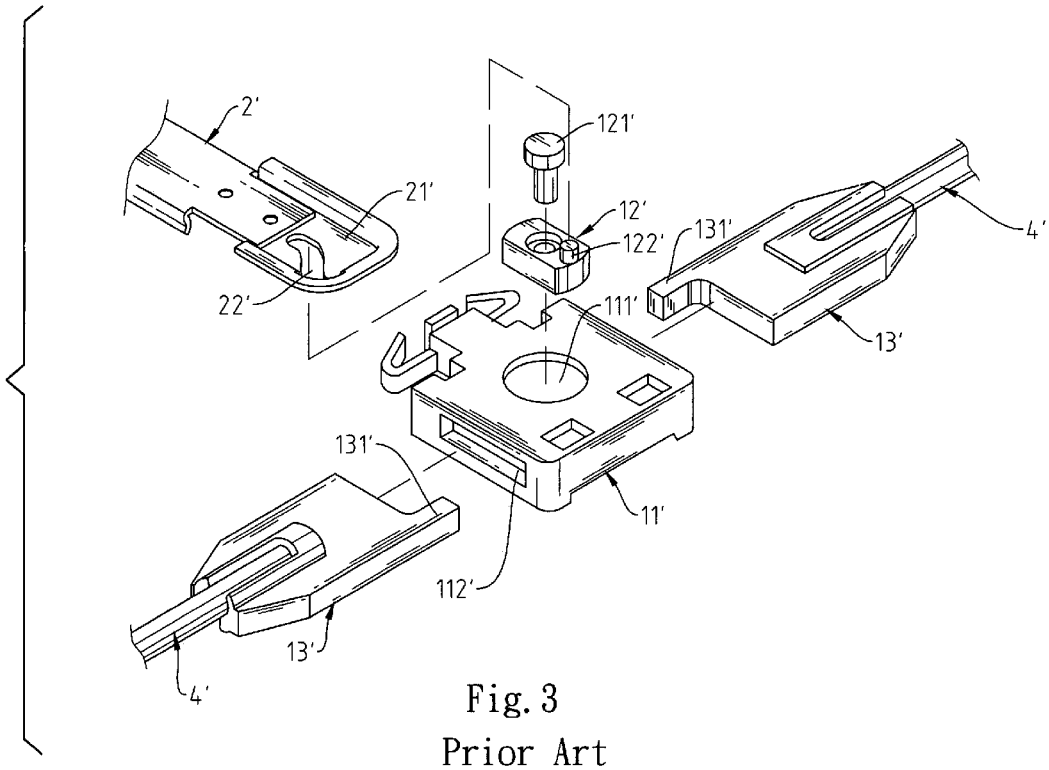
Fig. 3 Prior Art
FIG. 3 shows the relationship of each part of the prior art of drawer interlock.

As shown in FIG. 1, the space for installing the braking rod 4' is limited, in other word, it is necessary to take off the braking slides 13's out of the bracket 11' for installing the braking rod 4' first, then put back the braking slides 13' along with the braking rods 4'. To align the braking slides 13' with the slide slot 112' is bothersome work, an extra of the production cost.

Figure 4:
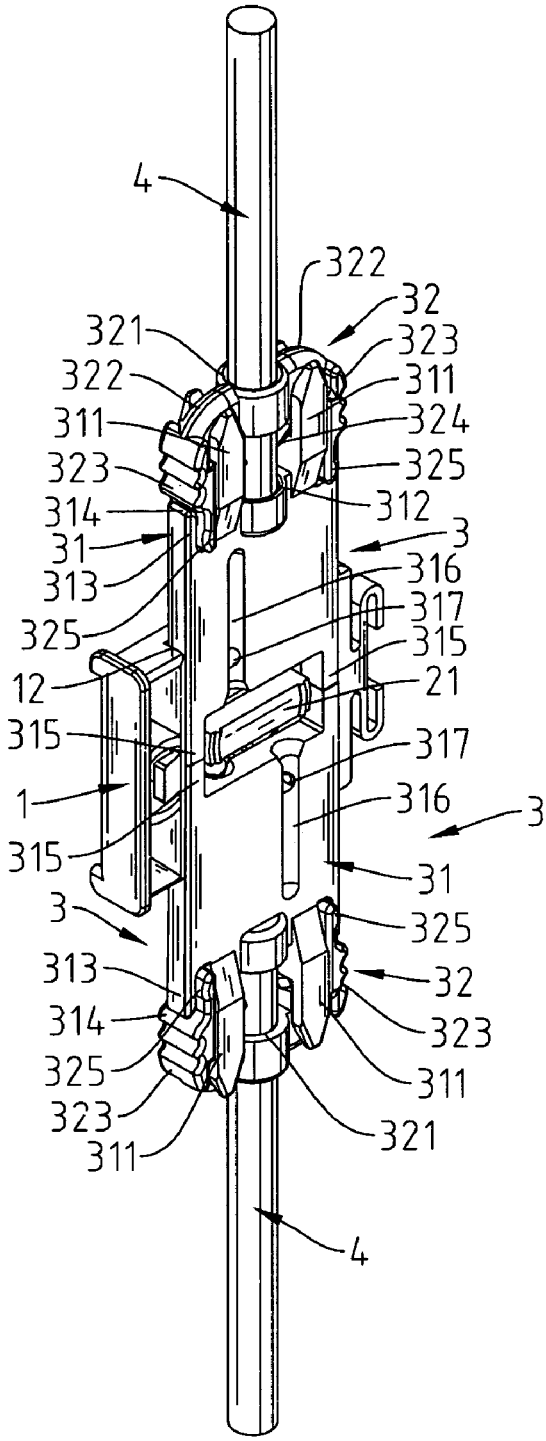
FIG. 4 shows layout of the drawer interlock of this invention.
Figure 5:
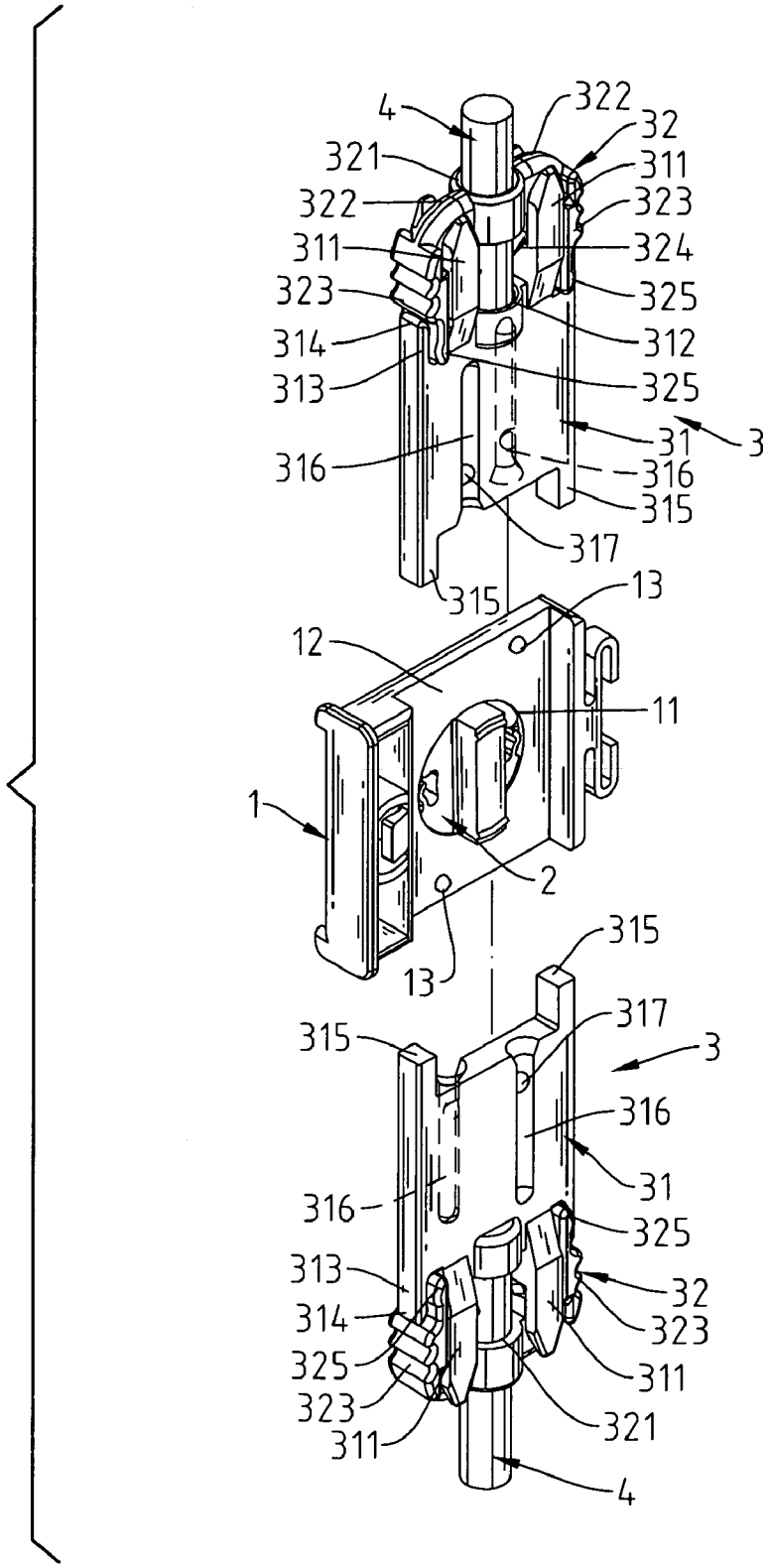
FIG. 5 shows the disassembly of the drawer interlock of this invention.

As shown in FIGS. 4 and 5, the drawer interlock developed in this invention mainly comprises a bracket 1, a cam 2 and two braking slides 3 in which the bracket 1 is locked at one end of the drawer rail. The cam 2 of the cam hole 11 is housed in the central slide slot 12 and two retaining studs 13 located at each end of the central slide slot 12 in staggered position. The cam 2 has a projected retaining block 21. Two braking slides 3 are inserted into each end of the slide slot 12 of the bracket 1.

Figure 6:
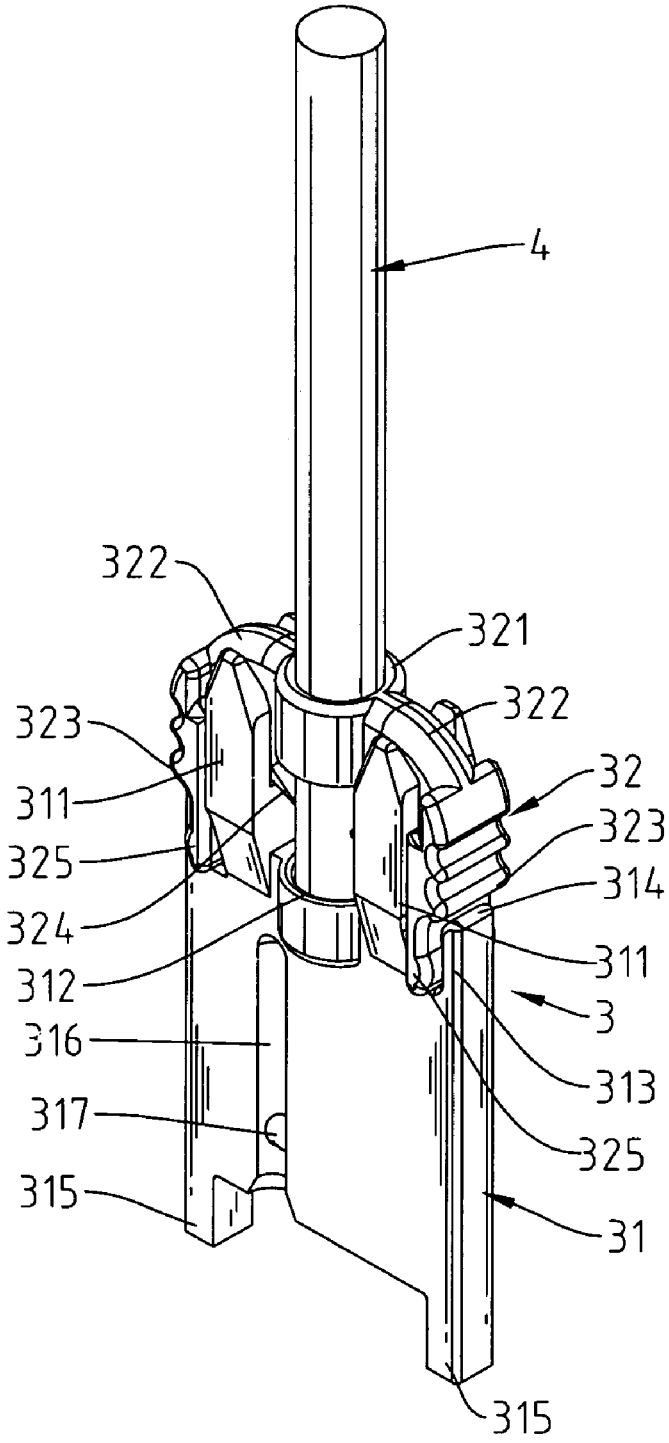
FIG. 6 shows the appearance of the braking slide of the drawer interlock of this invention.
Figure 7:
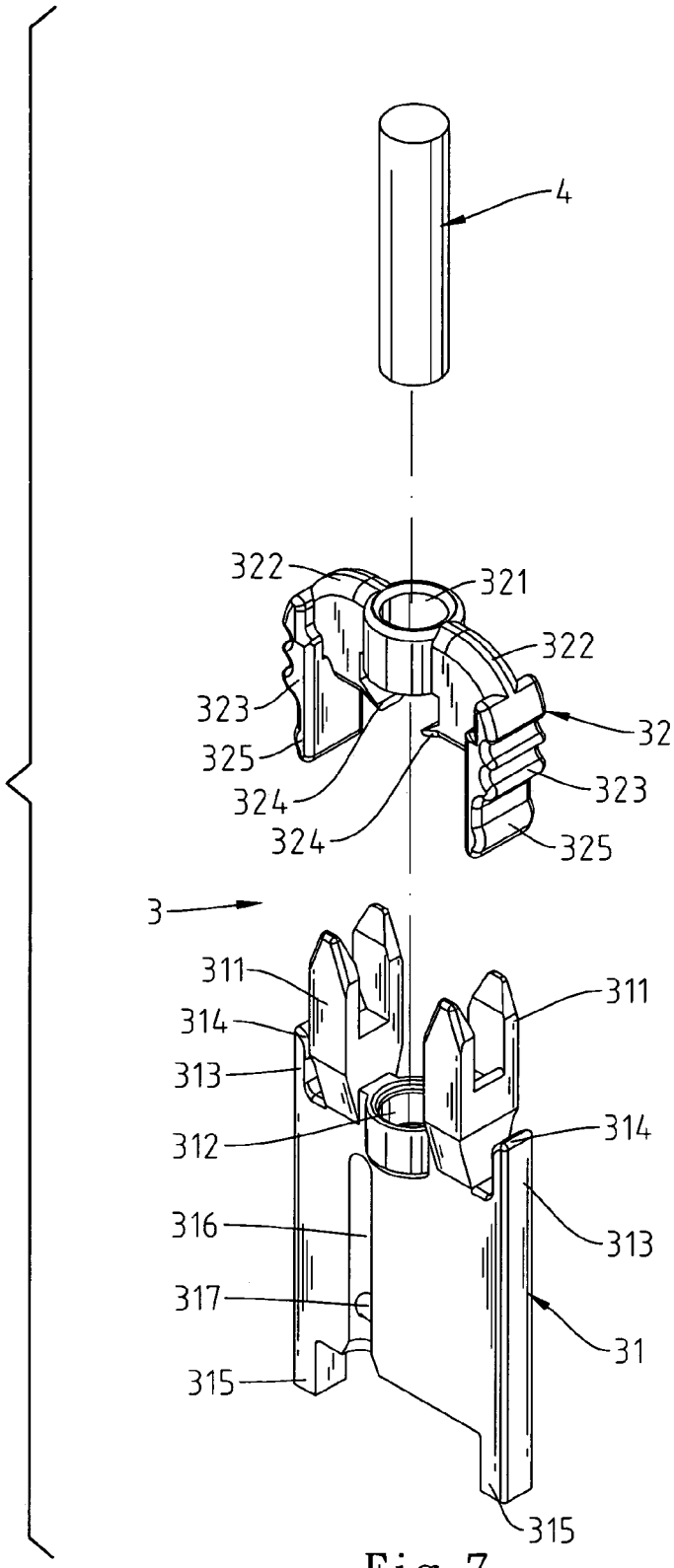
FIG. 7 shows the disassembly of the braking slide of the drawer interlock of this invention.
Figure 8:
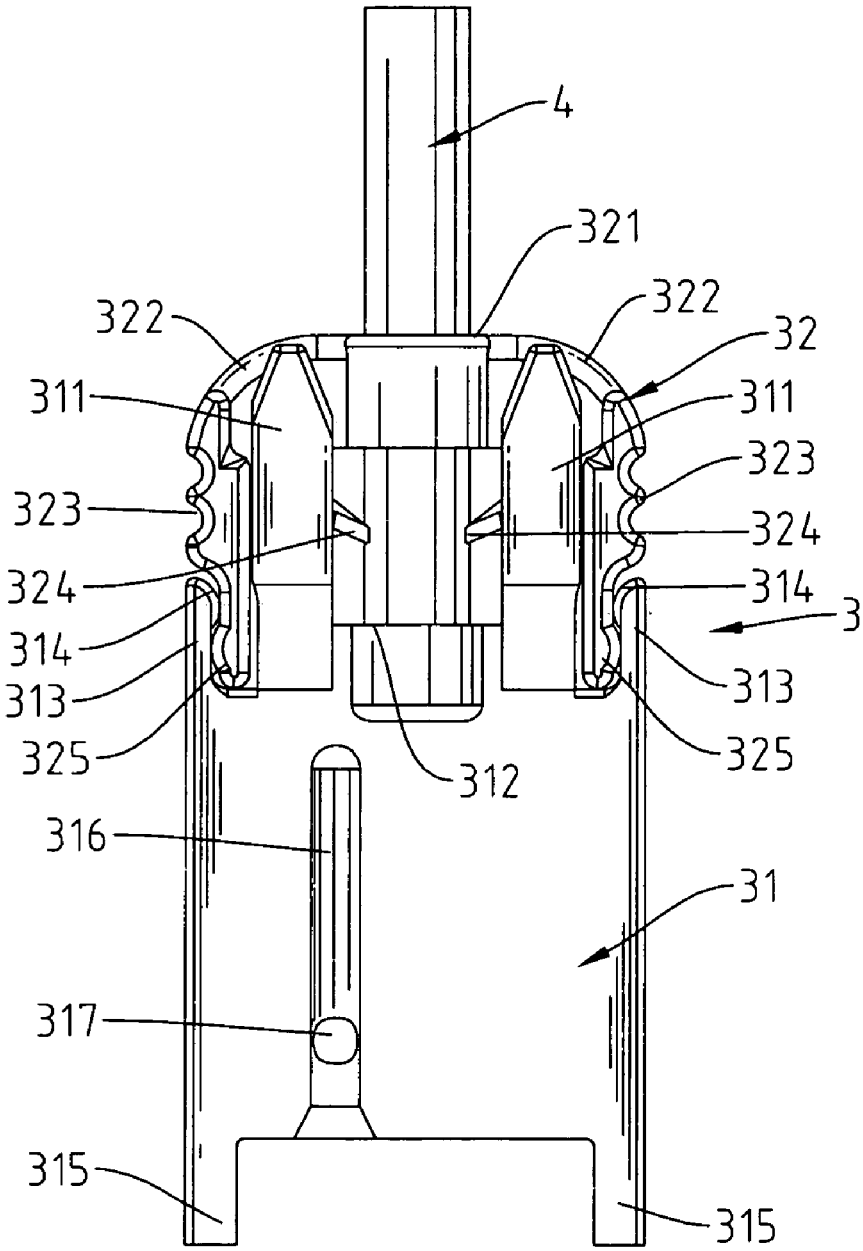
FIG. 8 shows the two spring hooks of the braking slide of the drawer interlock of this invention.

As shown in FIGS. 6 through 8, the braking slide 3 contains a base plate 31 and an insert sleeve 32. The base plate 31 contains two side clamps 311 and between the clamps 311, there is an insert hole 312 to receive the braking rod 4. The base plate 31 has a spring clip 313 at the outer rim (two spring clip 313 at the outer rim of the base plate 31 shown in FIG. 8 and one spring clip in FIG. 9.) the spring clip 313 has a projected flange 314 at inner side.

The insert sleeve 32 is a detachable part to be inserted into the base plate 31. The insert hole 312 aligned straightly with the clamp hole 321 on the insert sleeve 32. On two side rims of the clamp hole 321, there extends a plate 322 with a section of taper teeth 323. Beneath the clamp hole 321, there is circlip 324. At the far end of taper teeth 323, there grows a tenon 325. The space formed between two circlips 324 provides friction grasp when braking rod 4 passes. The braking rod 4 comes through the clamp hole 321 of the insert sleeve 32 and enters into the insert hole 312 on the base plate 31 and finally being held in the clamp channel 318 by a plate 322 of insert sleeve 32, and use taper teeth 323 hold in the spring clip 313 to be a spring clip sleeve. The tenon 325 and the flange 314 constitute a holding clamp so the insert sleeve 32 steadfast links on the upper part of the slide plate 31 to organize a complete braking slide 3. In the meantime, the braking rod 4 grasp by two circlips 324 and steadfast links on the braking slide 3 as shown in FIG. 8.

Figure 9:
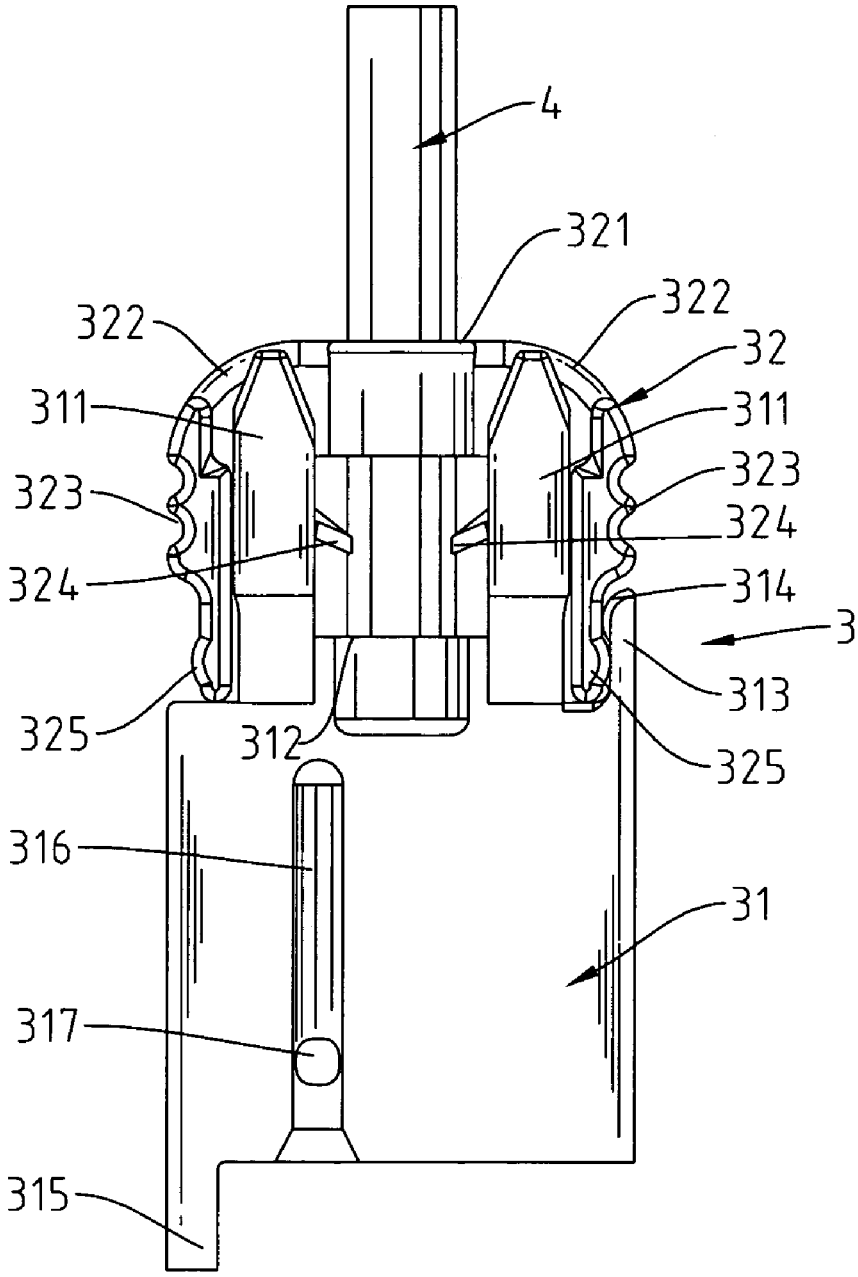
FIG. 9 shows another embodiment of the braking slide of the drawer interlock of this invention.
Figure 10:
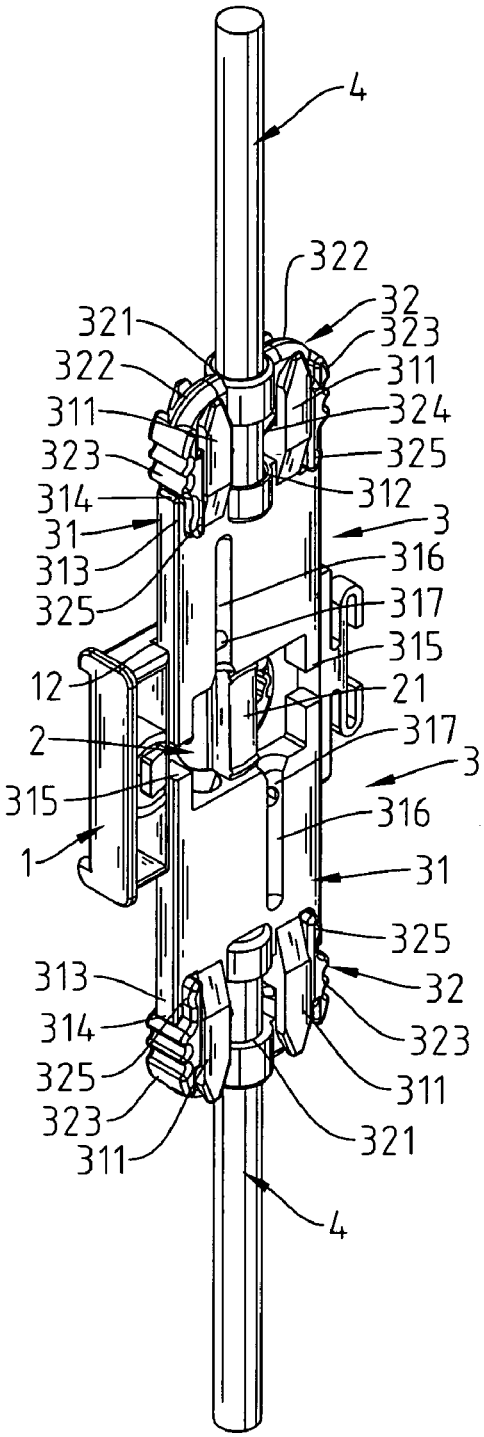
FIG. 10 shows the braking slide is holding the braking rod.

The base plate 31 has a protruded leg 315 (FIG. 8 shows two legs 315 and FIG. 9 shows one leg 315 only.) entering into the slide slot 12 of the bracket 1 and touching the retaining block 21 of slide slot 12. there is a guide groove 316 for the projected stud 13 on the slide slot 12 to move along, and the projected stud 13 corresponds to the guide groove 316 on the base plate 31. When the braking slide 3 moves outward, the retaining stop 317 will limit the travel distance of the braking slide 3 and prevents from falling off the slide slot 12 of bracket 1. The drawer interlock the drawer slide 2 and the drawer rail 3 constitute an integrated unit directly mounted on the drawer without further assembly.

In practice, while the retaining block 21 of the cam 2 is being turned at 90°, two braking slides 3 are being forced to move outward and the slide rod 4 has no way to go back to the direction of the braking slide 3. This displacement resistance rendered by the braking rod 4 will cause the upper and lower drawers in locked position. In the contrary, when the retaining block 21 of the cam 2 return back from 90° as shown in FIG. 4, the braking slides 3 leave sufficient displacement space for the braking rod 4 to retreat back, the lock on the upper and lower drawers is therefore freed.

Figure 11:
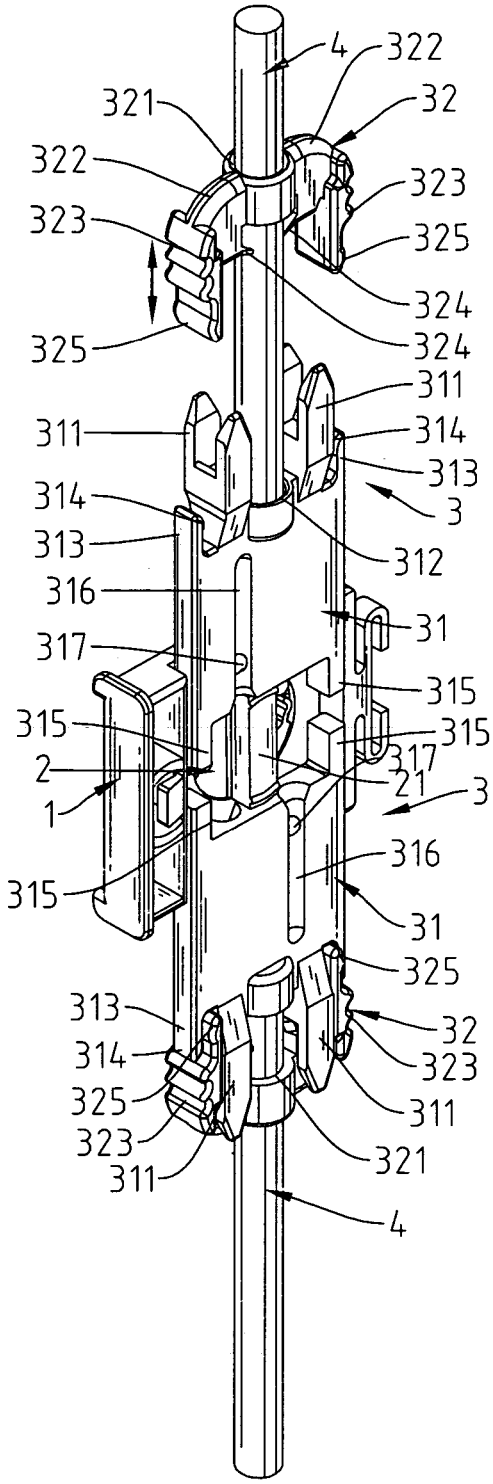
FIG. 11 shows practice that the braking slide holds the braking rod.

The drawer interlock of this invention is an integral element directly mounted on the drawer. As shown in FIG. 11, the braking rod 4 is inserted onto the insert sleeve 32 linking to the base plate 31, it means the braking rod 4 is inserted into the insert sleeve 32 first, then mounted on the base plate 31 and the space left for the baking rod 4 is not restrained. Installing the braking slides 3 of base plate 31 into the slide slot 12 of the bracket 1 first and installing the insert sleeve 32 and the braking rod 4 aftermaths which makes the alignment of the braking rod 4 easy in a very short time. This is the best way of assembly.

Viewing from the above statement, it is learned that the braking slide structure of the drawer interlock offers simple and fast assembly operation with great practicability and strong competition, a useful invention.

What is claimed is:

1. A braking slide structure of a drawer interlock comprising:

a braking slide having a base plate and an insert sleeve; the base plate having two clamp forks on a top thereof, an insert hole, at least one spring clip located on a side thereof, and a leg on a bottom thereof; the insert sleeve having a clamp hole and a plate with taper teeth extending from the clamp hole;

a bracket having a slide slot and a cam with a projected retaining block; and a braking rod;

wherein, the insert sleeve is inserted into the top of the base plate, the clamp hole is aligned with the insert hole of the base plate, the leg of the base plate is inserted into the slide slot of the bracket leaving room for the cam and block to rotate therein, the taper teeth engage the spring clip of the base plate to hold the base plate and the insert sleeve together, and the braking rod is inserted through the clamp hole and into the insert hole on the base plate so that the braking rod and braking slide are moveable between locked and released positions via the bracket.

2. The braking slide structure of the drawer interlock according to claim 1, wherein the spring clip of the base plate has a protruded flange.

3. The braking slide structure of the drawer interlock according to claim 1, wherein the plate of the insert sleeve has circlips located under the clamp hole, the two circlips are spaced apart a predetermined distance and frictionally engage the braking rod therebetween.

4. The braking slide structure of the drawer interlock according to claim 1, wherein the spring taper teeth having a tenon located on an outer rim thereof forming a latch with the spring clip on the base plate.

5. The braking slide structure of the drawer interlock according to claim 1, wherein the base plate having a guide groove for a projected stud in the slide slot to move along, the guide groove has a stop at an end thereof setting a limit for the braking slide to move outwardly.

* * * * *